United States Patent [19]

Robinson et al.

[11] 4,108,037

[45] Aug. 22, 1978

[54] ELECTRONIC ORGAN HAVING DIFFERENT SELECTABLE MODES OF PLAYING THE ACCOMPANIMENT KEYBOARD

[75] Inventors: John William Robinson; Brian Norris Wilcox, both of Jasper, Ind.

[73] Assignee: Kimball International, Inc., Jasper, Ind.

[21] Appl. No.: 710,791

[22] Filed: Aug. 2, 1976

[51] Int. Cl.[2] ..... G10H 1/00

[52] U.S. Cl. ..... 84/1.03

[58] Field of Search ..... 84/1.01, 1.03, 1.17, 84/1.24, DIG. 22

[56] References Cited

U.S. PATENT DOCUMENTS

| | | | |
|---|---|---|---|
| 3,951,028 | 4/1976 | Robinson | 84/1.01 |
| 3,955,460 | 5/1976 | Southard | 84/1.17 |
| 3,986,423 | 10/1976 | Ressum | 84/1.01 |
| 3,990,339 | 11/1976 | Robinson et al. | 84/1.17 |
| 4,031,786 | 6/1977 | Kaplan | 84/1.03 |

*Primary Examiner*—Robert K. Schaefer
*Assistant Examiner*—Vit W. Miska
*Attorney, Agent, or Firm*—Albert L. Jeffers; John F. Hoffman

[57] ABSTRACT

An electronic organ having solo, accompaniment, and pedal keyboards, or manuals, and adjustable into different modes of playing for at least the accompaniment keyboard.

In a first playing mode, the accompaniment keyboard plays in a conventional manner with each key of the keyboard which is depressed actuating a respective keyer.

In a second selectable playing mode, the keys of the accompaniment keyboard are disabled for actuating keyers in a conventional manner and, instead, a selected group of the keys, referred to as "chord playing" keys, are made effective for playing chords by having each of the chord playing keys actuate a respective group of keyers while the key is depressed.

In a third playing mode, the keys of the accompaniment manual are disabled for actuating respective keyers and, instead, the same group of "chord playing" keys referred to above are enabled for actuating the keyers pertaining to respective chords singly, or in groups, sequentially at predetermined time intervals. At this time further, or even, different notes can be sounded.

20 Claims, 12 Drawing Figures

FIG. 5
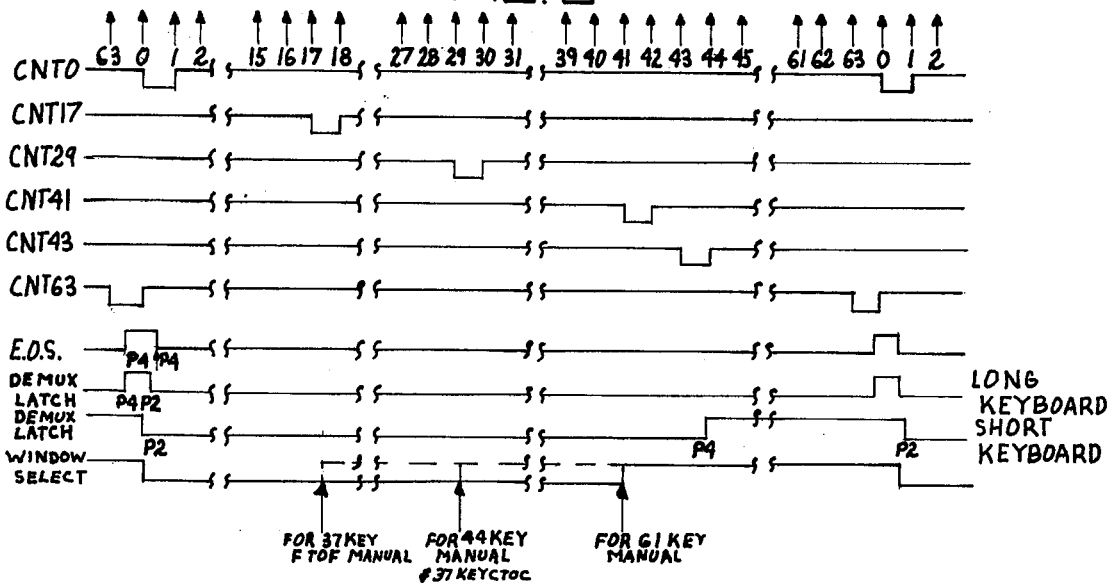
FIG. 10
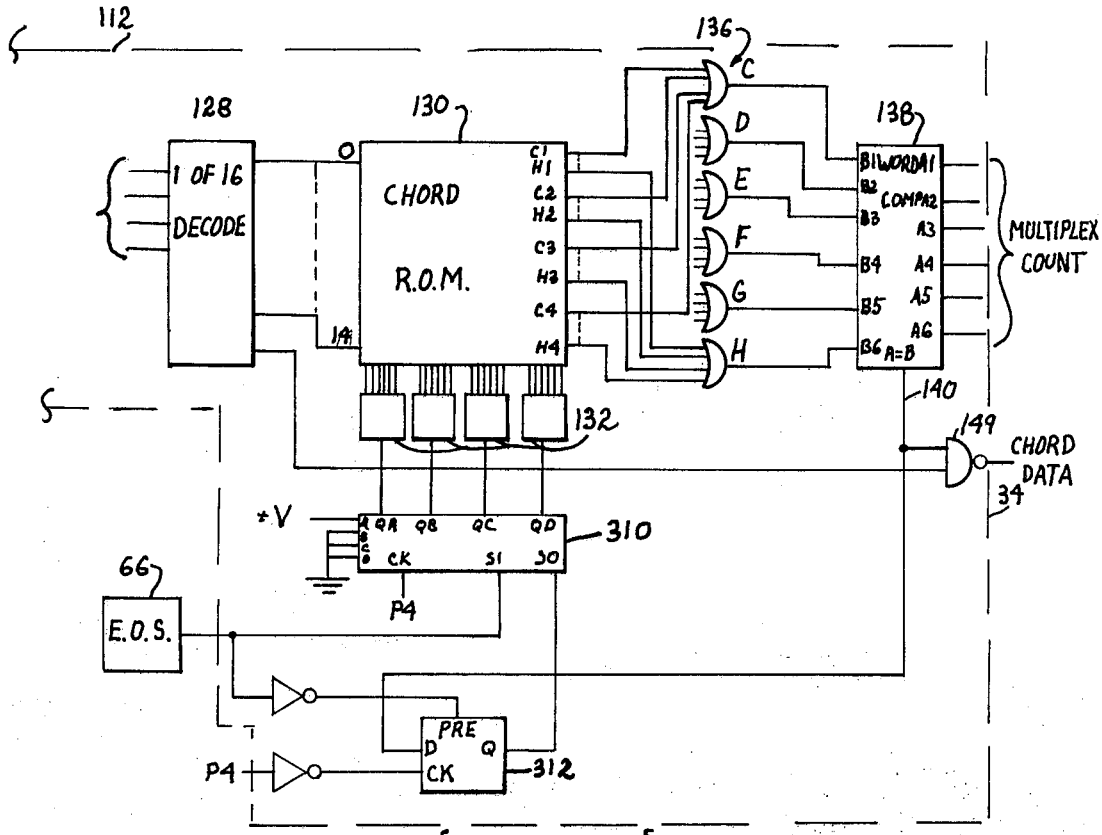
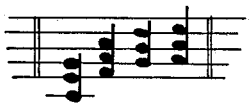
FIG. 11
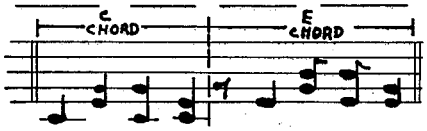
FIG. 12

ELECTRONIC ORGAN HAVING DIFFERENT SELECTABLE MODES OF PLAYING THE ACCOMPANIMENT KEYBOARD

The present invention relates to electronic organs and is particularly concerned with an electronic organ having circuitry associated with the accompaniment keyboard, or manual, which is adjustable to provide for different modes of playing the accompaniment manual.

Electronic organs of the nature with which the present invention is concerned are, of course, well known and consist of solo and accompaniment and pedal keyboards, a tone generator, keyers connecting the tone generator to voice formant means which, in turn, are connected through amplifier means to speaker means. The keys control the actuation of the keyers thereby to control the supply of tone signals from the tone generator to the voice formant means and amplifier and speaker means.

A known technique in connection with electronic organs is that of multiplexing the keys of any one or all of the keyboards and employing the data thus developed for actuating the keyers. The present invention is primarily concerned with the application of multiplexing techniques to the accompaniment keyboard of the organ and to the processing of the data thus derived to provide for selectable and different modes of operation of the accompaniment keyboard.

A primary object of the present invention is the provision of a circuit arrangement for use with an electronic organ, especially for use with the accompaniment keyboard of an electronic organ, which is readily adjustable to provide for different modes of operation of the accompaniment keyboard.

Another object of the present invention is the provision of a circuit arrangement for use with an electronic organ, and especially for use with the accompaniment manual of the organ, which will permit the organ to play a single note in response to the depression of a single key of the accompaniment manual, or to play a chord when a single key of the accompaniment manual is depressed, or to play a predetermined group of notes in sequence when a key of the accompaniment manual is depressed. The accompaniment and solo manuals may be separate or end to end and, generally, refer to groups of keys played by the left and right hands, respectively.

A still further object is the provision of a circuitry of the nature referred to above in which multiplexing techniques are employed.

A still further object is the provision of a circuit arrangement of the nature referred to above in which the components making up the circuitry consist, in the main, of integrated circuit chips, and the like.

BRIEF SUMMARY OF THE INVENTION

According to the present invention, an electronic organ is provided having solo and accompaniment and pedal keyboards, or manuals. The organ also comprises a tone generator and keyers supplied by the tone generator, voice formant means supplied by the keyers, and amplifier and speaker means supplied by the voice formant means.

At least the accompaniment manual keys, according to the present invention, are multiplexed according to known techniques, thereby to establish a data stream on each scan of the keyboard in which signals corresponding to depressed keys appear in respective time slots of the data stream. A data stream of the nature referred to consists of time displaced data bits, one for each key scanned. The bits are at one logic level when a scanned key is not depressed and at another logic level when the scanned key is depressed. In the case of the present invention, the data stream is held at logic 1 except while scanning a depressed key and, at which time, the respective data bit goes to logic zero.

When the organ is operating in a first, conventional mode, the aforementioned data stream is processed through a demultiplexer circuit, also of a conventional nature, and the aforementioned signals corresponding to depressed keys are operable for actuating respective keyers.

In a second mode of operation, the supply of the aforementioned data stream to the demultiplexing circuit is interrupted and, instead, an alternate data stream is established. This alternate data stream is normally at logic 1 and logic 0 signals effective for actuating keyers are supplied in respective time slots. This alternate data stream containing the supplied signals is delivered to the demultiplexing circuit and is demultiplexed therein and actuates the keyers in conformity with the logic 0 signals which have been impressed thereon. The signals are supplied to the alternate data stream in conformity with the depression of one key of a selected group of the accompaniment manual keys which may be referred to as "chord playing" keys.

The keyer actuating signals referred to which are impressed on the alternate data stream are derived from a read only memory which contains digital information corresponding to the binary words employed for addressing respective keys during multiplexing of the accompaniment manual. The read only memory referred to has multiple subsections which are consecutively enabled during a single multiplexing cycle so that a plurality of signals effective for actuating keyers are inserted on the alternate data stream during each interval equal to a complete multiplexing cycle of the accompaniment keyboard. The insertion of the signals on the data stream is accomplished in a word comparator which receives one set of inputs from the multiplexing counter which normally accomplishes the multiplexing of the accompaniment keyboard, while the other set of inputs comprises the binary data supplied from the read only memory.

When the two sets of inputs to the word comparator are equal the word comparator supplies an output pulse which results in the insertion of a key down signal in the alternate data stream while also enabling the next subsection of the read only memory and which establishes a further word to be supplied to the word comparator. In this, second, mode of operation, the depressing of a "chord playing" key causes a corresponding chord to sound as long as the key is depressed.

In the third playing mode, the data stream from the accompaniment manual keyboard is again interrupted and an alternate data stream is again established. As in the above referred to "second mode", the "chord playing" keys of the accompaniment manual are effective but the pedal keys could be employed, if desired, in place of accompaniment keys.

In the third mode of operation, substantially the same procedure is followed as in the above described second mode of operation but, instead, of enabling all of the sections of the read only memory sequentially during a single multiplexing cycle, the several sections of the read only memory, singly or in multiple, are sequentially enabled at a substantially slower rate by means of a low frequency source of clock pulses which may, for example, be derived from a rhythm unit associated with the organ.

The rate at which the subsections of the read only memory are enabled is such that the notes corresponding to the chord pertaining to a particular "chord playing" key, or other notes as may be programmed into the read only memory, will sound at intervals while the key is depressed, with the intervals substantially corresponding to the rate of enabling of the different subsections of the read only memory. The low frequency clock pulses may be supplied at the rate of, say, sixteen to a measure so that up to sixteen notes, or pairs or groups of notes, can be sounded in succession in a measure.

The sequential enabling of the subsections of the read only memory is under the control of a second read only memory which can be programmed to effect the enabling of the subsections of the first mentioned read only memory in any desired order. A further feature in connection with the third mode of operation is that the second read only memory can be programmed to provide for pauses during which no note is sounded.

Summarizing briefly, at the end of each scan of the manual a set of notes are loaded into the machine from the pattern read only memory. As each of these words is scanned by the multiplexer, it is erased and is not reloaded until the next scan so, thus, we have the notes being scanned at a very high rate and placed on the data stream and changed only on the command of the rhythm clock.

The exact nature of the present invention will be more fully comprehended with reference to the following detailed specification taken in connection with the accompanying drawings in which:

FIG. 5 is another chart showing further timing relationships within the circuit.

FIG. 10 is a view of a modification.

FIG. 11 shows operation of the organ in mode II.

FIG. 12 shows operation of the organ in mode III.

DETAILED DESCRIPTION OF THE INVENTION

It has been mentioned that an electronic organ according to the present invention can be substantially conventional in respect of the solo and accompaniment and pedal keyboards, or manuals.

The present invention is concerned with special circuitry, especially for use with the accompaniment manual, and the detailed drawings illustrate such circuitry in association with the accompaniment keyboard. It will be understood, however, that the present invention is applicable to any of the keyboards of the organ or to more than one thereof, if so desired.

According to the present invention, as mentioned above, the organ according to the present invention is playable in any of three selectable modes. Parts of the circuitry employed are common to all of the three playing modes referred to. In all of the modes of operation of the organ, multiplexing techniques are employed.

Figure 1:
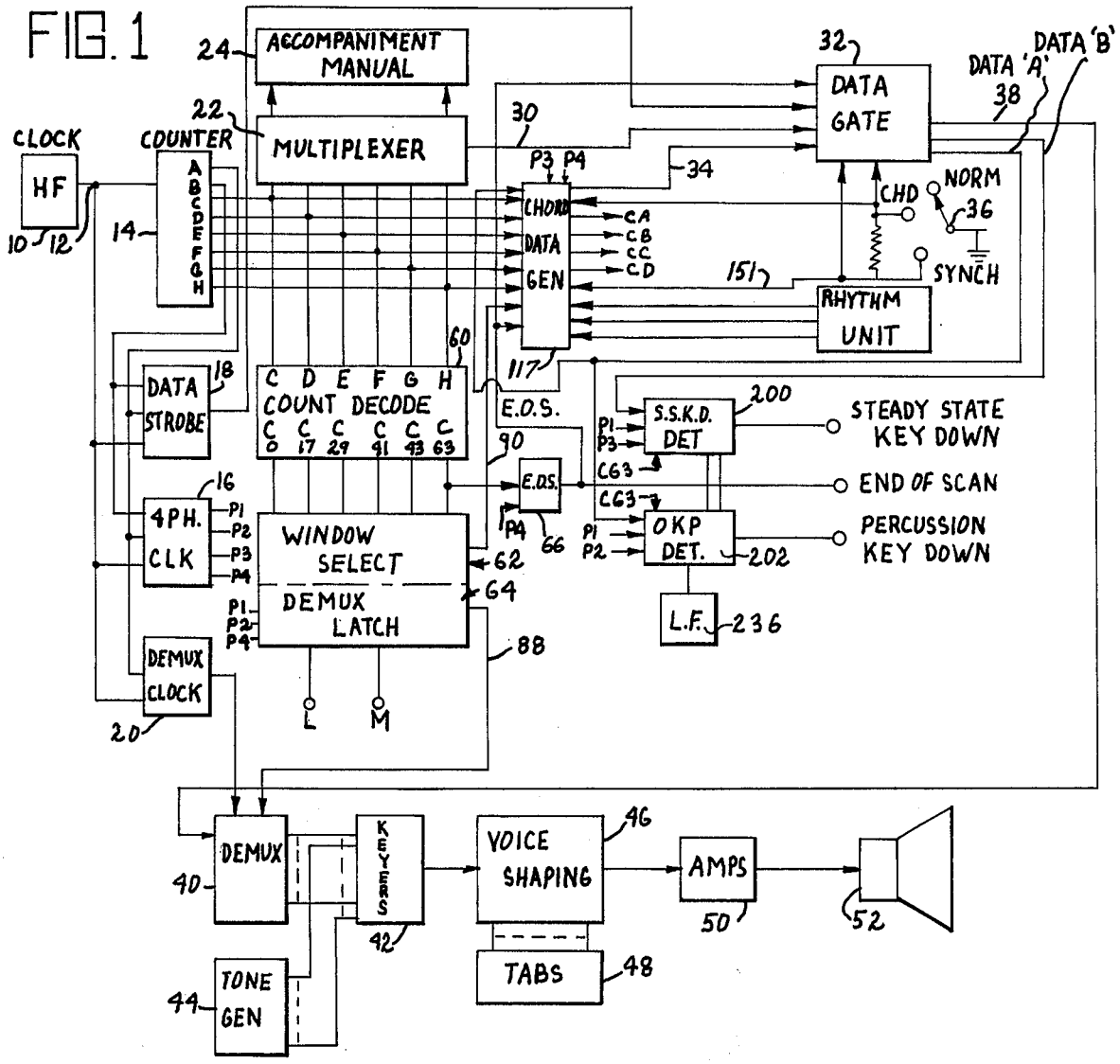
FIG. 1 is a simplified block diagram of a portion of an electronic organ circuit embodying the present invention.

In the drawings, FIG. 1 is a simplified block diagram of the entire system.

The portions of the circuit shown in FIG. 1 which are common to all three modes of play will be described first.

Referring to FIG. 1, a master clock 10 supplies a train of clock pulses at, say, 150 KH to wire 12 which is connected to the input of an eight bit counter 14. The two least significant bit outputs of counter 14, marked A and B, are used, together with the clock pulse train on wire 12, to develop certain timing signals in a four phase clock 16, and a data strobe 18. Bit B from counter 14, together with the clock pulse on wire 12 inverted, is used in a demultiplexer (demux) clock 20. The operation of these circuits and the waveforms associated therewith will be discussed in more detail hereinafter.

The remaining six bit outputs from counter 14, marked C, D, E, F, G and H are connected to the control inputs of a sixty-four line to one line multiplexer 22 used to multiplex the accompaniment manual 24 to develop a pattern of binary signals in time displaced relation, with each signal consisting of a first key down signal representing a depressed key in a respective time slot, or a second signal representing a nondepressed key. The referred to pattern of binary signals obtained during a scan of the keyboard is hereinafter referred to as data stream 30. Data stream 30 is high, or logic 1, except when a key down signal appears therein and at which time the data stream goes low, or logic 0.

Data stream 30 is connected to one input of a data gate 32. A second data stream 34 is connected to a second input of data gate 32. Data gate 32 will pass a selected one only of data streams 30 and 34 to an output terminal 38. The selection of data streams is controlled by control inputs to data gate 32 from a mode selector switch 36.

The data stream output on line 38 is connected to the input of a demultiplexer 40. Demultiplexer 40 produces a plurality of outputs, with each output connected to the enabling input of one of a group of keyers 42. The second input to each of the keyers is an audio frequency tone signal produced by a tone generator 44. Demultiplexer 40 will enable certain ones of keyers 42 in response to previously mentioned first key down signals in the data stream from terminal 38.

Tone signals passed through by the enabled ones of keyers 42 are connected to voice formant or signal shaping circuit means 46 which are under the control of tab switches 48. The shaped tone signals are then amplified by amplifier means 50 and converted into audible tones by speaker means 52.

Figure 3:
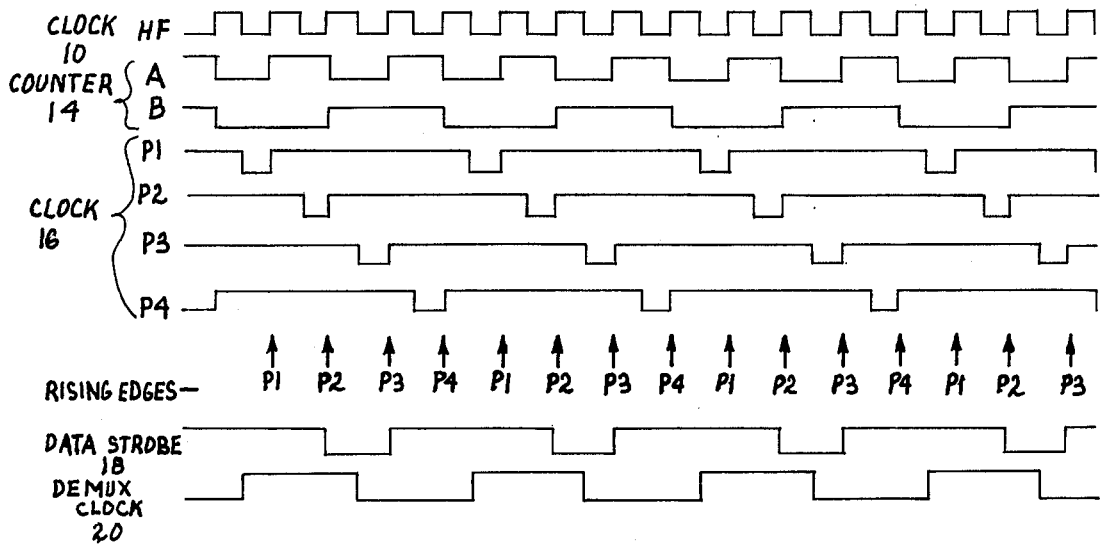
FIG. 3 is a chart showing some of the timing relationships within the circuit.
Figure 2:
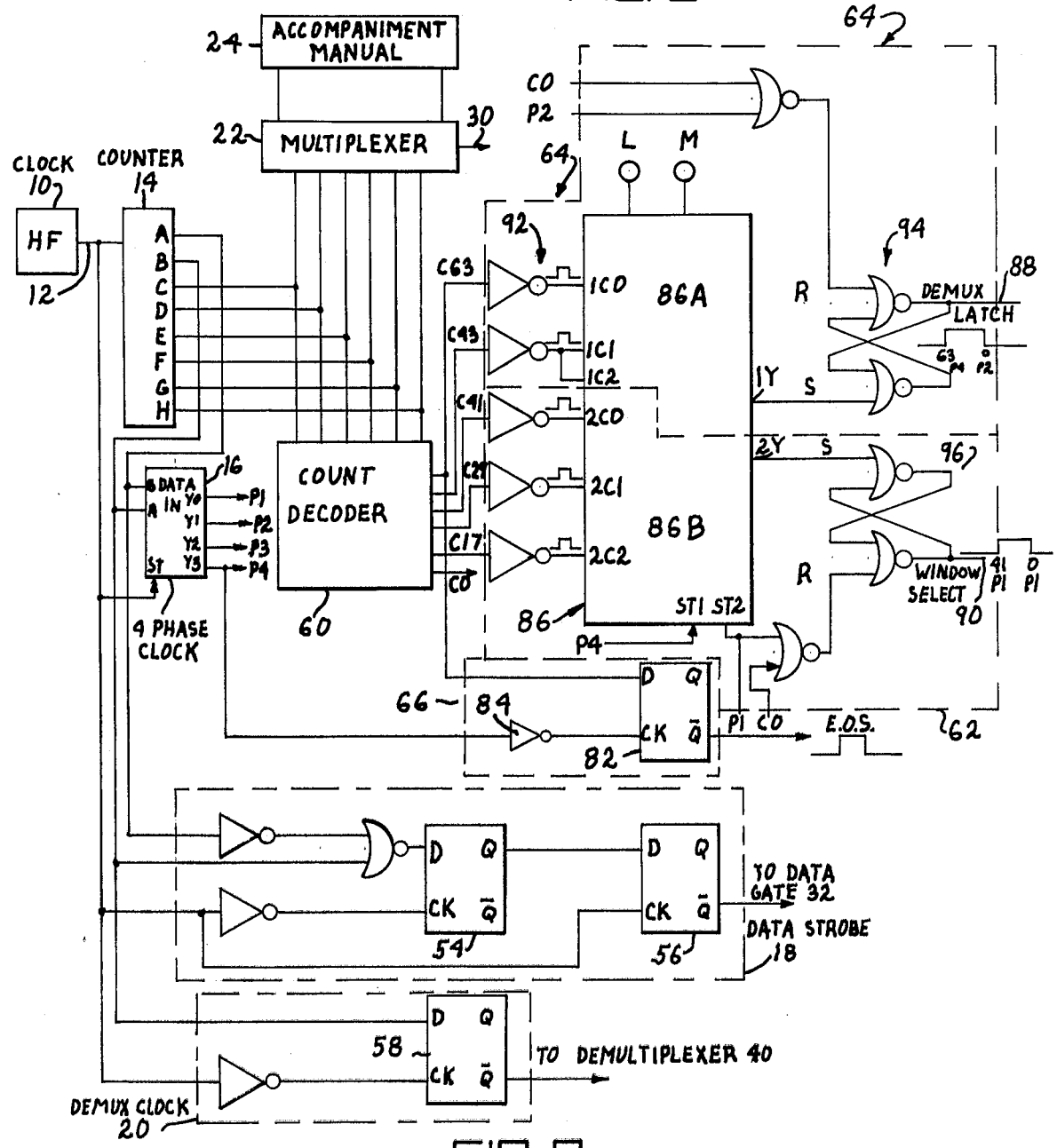
FIG. 2 is a portion of the circuit of FIG. 1 showing elements of the circuit more in detail.

The operation of the previously mentioned four phase clock 16, the data strobe 18 and the demultiplexer clock 20 can best be understood by referring to FIGS. 2 and 3.

The four phase clock 16 consists of a one line to four line demultiplexer such as the component identified by part No. 74155 in the Texas Instrument Catalog of 1973.

The pulse train on wire 12, and the A and B outputs from counter 14, are connected to the strobe input and the B and A addressing inputs, respectively. The four line outputs of clock 16, and which are labeled P1, P2, P3 and P4 in FIG. 2, produce time displaced clock pulses repetitively and sequentially, as shown in FIG. 3. The clock pulses produced at terminals P1 through P4 will be referred to hereinafter as clocks P1, P2, P3 and P4, respectively, and are so marked in FIG. 3.

FIG. 3 shows the time relation between high frequency clock pulses on wire 12, bits A and B from counter 14, and the four phase clocks P1 to P4. It should be noted at this point that, although clocks P1 through P4 are time displaced relative to each other, pulses from all thereof occur during the time interval between successive falling edges of the B output from counter 14 and which interval equals one key scan period of multiplexer 22.

Data strobe 18 is shown within a dotted line in FIG. 2. Outputs A and B from counter 14 are combined as shown to form the D input to an edge triggered D type flip-flop 54, which is clocked by inverted clock train pulses from wire 12. The Q output of flip-flop 54 forms the D input to another D type flip-flop 56, which is clocked by pulses from wire 12. The operation of both D type flip-flops 54 and 56 is such that the logic level present at the D input is transferred to the Q output during a rising edge of the clocking input. The Q output will then retain that logic level until the next rising edge on the clocking input. The inverted Q, or $\overline{Q}$, output of flip-flop 56 forms the data strobe output, and the associated wave form is shown in FIG. 3, labeled data strobe, and is used in the data gate 32 to shape the data on the selected data stream.

The demultiplexer clock 20 consists of an edge triggered flip-flop 58, with the B output from counter 14 forming the D input and inverted clock train pulses from wire 12 forming the clocking input. The inverted Q, or $\overline{Q}$, output from flip-flop 58 forms the demultiplexer clock output, and the wave form is shown in FIG. 3 labeled 'Demux Clock'. The demultiplexer clock output provides properly timed falling edges to demultiplexer 40.

Another group of timing circuits shown in block form in FIG. 1 are count decoder 60, window select 62, demultiplexer latch 64, and end of scan 66. These circuits produce pulses at specific intervals during a complete cycle of counter 14. The window select 62 determines the keys that will form the "chord playing keys"; the demultiplexer latch 64 latches the key down signals for actuating keyers; and the end of scan 66 determines the end of one complete keyboard scan.

Figure 4:
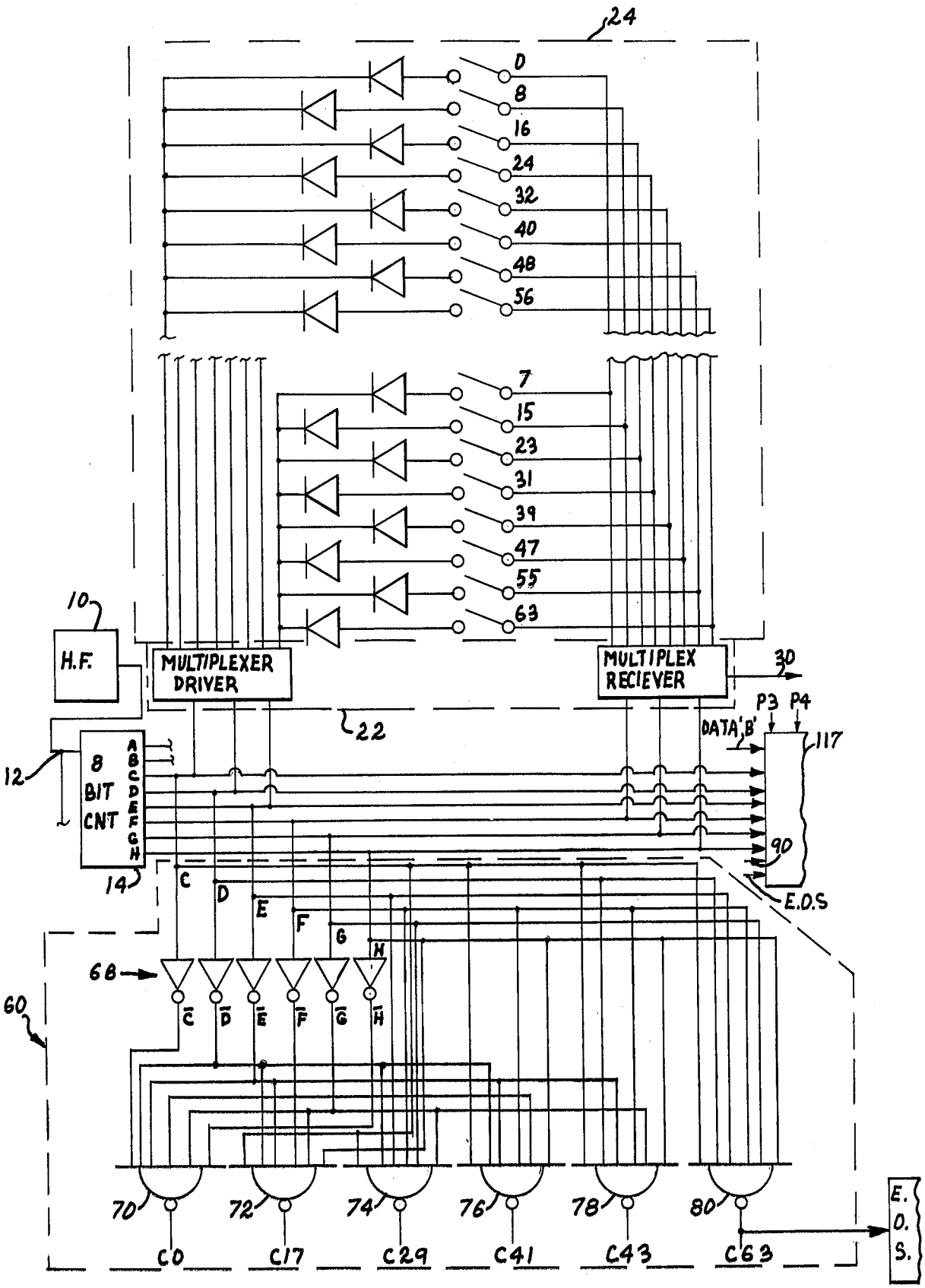
FIG. 4 shows the multiplexing means.

Count decoder 60 is shown in FIG. 4. Outputs marked C through H of counter 14, and the inversions of these outputs developed at the outputs of inverters 68, are connected to the inputs of NAND gates 70 through 80 in such a manner that the outputs of NAND gates 70 through 80 will produce pulses on predetermined counts of counter 14. The output of each gate is labeled with the count during which it will pulse. For instance, gate 70 will produce a pulse during count 0, and is, therefore, labeled C0. Gates 72 through 80 will pulse during counts C17, C29, C41, C43 and C63, all as indicated in FIG. 4.

Again referring to FIG. 2, an edge triggered D type flip-flop 82 is connected with the C63 output of count decoder 60 as the D input and the P4 clock through inverter 84 to the clocking input, to form the end of scan circuit 66. The inverted Q output of flip-flop 82 forms the end of scan output, and the associated output wave form is shown in FIG. 5.

Demultiplexer latch circuit 64, and window select circuit 62, are shown inside the labeled dotted lines in FIG. 2. Demultiplexer latch 64 produces a pulse on line 88 which rises to logic 1 after all the keys of the accompaniment manual 24 have been scanned by multiplexer 22. On a sixty-one note manual, the demultiplexer latch pulse on line 88 will rise to logic 1 on count 63 while, for a forty-four note manual, the rise will occur on count 43 of counter 14. For both manual lengths, the pulse on line 88 will return to logic 0 on count 0 of counter 14. In a similar fashion, the again depending on the length of the accompaniment manual, the window select circuit 62 will produce a pulse on line 90 which will rise to logic 1 on count 41, count 29, or count 17 of counter 14, and will return to logic 0 on count 0 of counter 14. The same demultiplexer latch and window select circuits are installed in organs with different length keyboards, and the selection of the proper counts to match the length of the keyboard is controlled by a dual four-line-to-one-line multiplexer 86. Multiplexer 86 is conveniently a Texas Instrument integrated circuit SN 74153 (Catalog 1973).

Referring to FIG. 2, the outputs of count decoder 60 are inverted in inverters 92 and form the inputs to multiplexer 86. Count decoder outputs C63 and C43 are connected to the inputs of one-half 86A of multiplexer 86, while count decoder outputs C41, C29 and C17 are connected to the inputs of the second half 86B of multiplexer 86. Two terminals, marked L and M in FIG. 2, form the addressing inputs to multiplexers 86A and 86B. Terminals L and M determine which of the inputs to the multiplexers will be passed to the outputs, labeled 1Y and 2Y, respectively, and are permanently connected to logic 1 or logic 0 at the time of manufacture of the organ. In an organ with a sixty-one note manual, terminal L and terminal M are both connected to logic 0 and multiplexer 86A passes C63 to output 1Y and multiplexer 86B passes C41 to output 2Y. For a forty-four note manual, terminal L is connected to logic 1 while terminal M is connected to logic 0, and multiplexer 86A passes C43 to output 1Y and multiplexer 86B passes C29 to output 2Y. Finally, for a thirty-seven note manual, terminal L is connected to logic 0, terminal M is connected to logic 1, and multiplexer 86A passes C43 to output 1Y and multiplexer 86B passes C17 to output 2Y.

Output 1Y from multiplexer 86A is connected to the set input of an S-R flip-flop 94. The reset input to flip-flop 94 is clocked by CO NOR'D together with clock P2. The output of flip-flop 94 is connected to line 88, and forms the demultiplexer output discussed previously. The demultiplexer latch wave form shown in FIG. 5 has terminals L and M connected for a sixty-one note manual. The pulse on line 88 is used in the demultiplexer 40 to maintain proper synchronism with multiplexer 22.

Output 2Y from multiplexer 86B is connected to the set input of an S-R flip-flop 96. The reset input to flip-flop 96 is pulsed by CO NOR'D together with clock P1. The output of flip-flop 96 forms the window select command and is connected to line 90. FIG. 5 shows the wave form produced on line 90 when terminals L and M are connected for a sixty-one note manual.

As mentioned previously, the circuit of the present invention is operable in any of three modes. Selection of a mode of play is controlled by a mode selector switch 36. Mode selector switch 36 is connected to the data gate circuit 32 to control the selection of the data streams as previously described, and to a chord data generator 117 to be described hereinafter.

Figure 6:
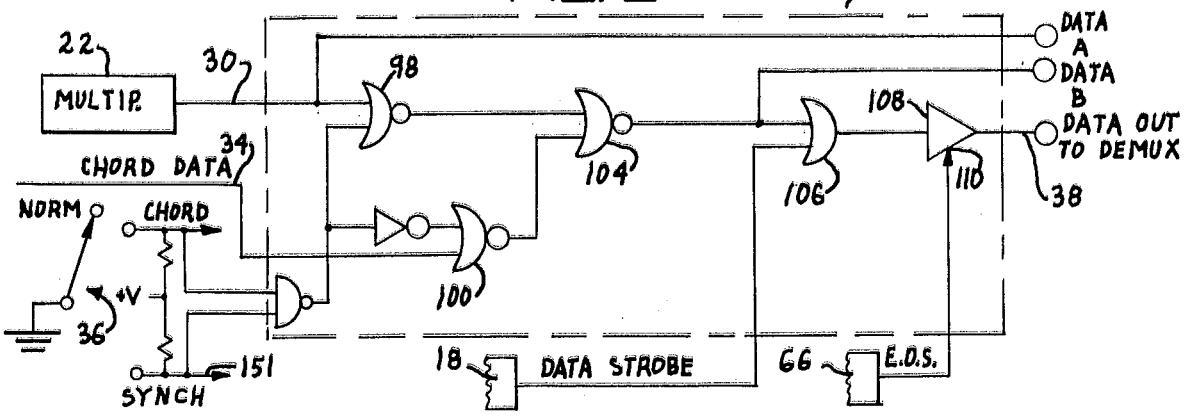
FIG. 6 is a part of the circuit showing the selection of a data stream.

With mode selector switch 36 in the position labeled NORM, data stream 30 is passed to output terminal 38. Referring to FIG. 6, data gate 32 is shown in more detail. Data streams 30 and 34 are connected to one input of each of NOR gates 98 and 100. The second inputs of NOR gates 98 and 100 form enabling inputs. The inputs from selector switch 36 are NANDED together in NAND gate 102 and form the enabling input to NOR gate 98. The output of gate 102 is inverted to form the enabling input to NOR gate 100. With selector switch 36 in the position marked NORM, NOR gate 98 will be enabled to pass data stream 30, while with selector switch 36 in either of the positions labeled CHORD or SYNC, NOR gate 100 will be enabled to pass data stream 34.

NOR gate 104 combines the outputs of NOR gates 98 and 100, while the output of NOR gate 104 is connected to one input of an OR gate 106. The second input to OR gate 106 is connected to the data strobe output from data strobe 18. The output of OR gate 106 is connected to the data input of a buffer gate 108. Gate 108 has an enabling input 110, which is connected to the end of scan output pulse from end of scan circuit 66. The end of scan pulse is effective to disable the output of buffer gate 108 during the positive portion of the pulse. Secondary outputs labeled DATA 'A', and DATA 'B', as shown in FIG. 6, are provided for use in portions of the circuit to be described hereinafter.

The following portion of the detailed description will be divided into three sections, and will deal individually with the three selectable modes of operation in the circuit. MODE 1:

With selector switch 36 in the NORM position, gate 98 of chord gate 32 is enabled, the accompaniment manual is multiplexed by multiplexer 22, and the developed data stream 30 is passed by data gate 32 to terminal 38 as previously discussed. As described earlier, the data stream present at terminal 38 is connected to demultiplexer 40 to be processed in a conventional manner. This operating mode, MODE 1, is equivalent to conventional accompaniment manual operation, with the depression of keys in the accompaniment manual causing corresponding tones to be sounded.

MODE 2:

With the selector switch 36 in the position labeled CHORD, gate 100 of chord gate 32 is enabled, data stream 30 is disabled at gate 98 of data gate 32, and data stream 34 is passed to terminal 38 for processing by the demultiplexer 40. In this mode of play, data stream 34 will contain key down signals in timed locations, or respective time slots, corresponding to the notes of a chord. As mentioned previously, data stream 34 is high (1) except for the key down signals which are low (0). Selection of the chord is controlled by depression of one of a group of "chord playing" keys on the accompaniment manual.

Figure 7:
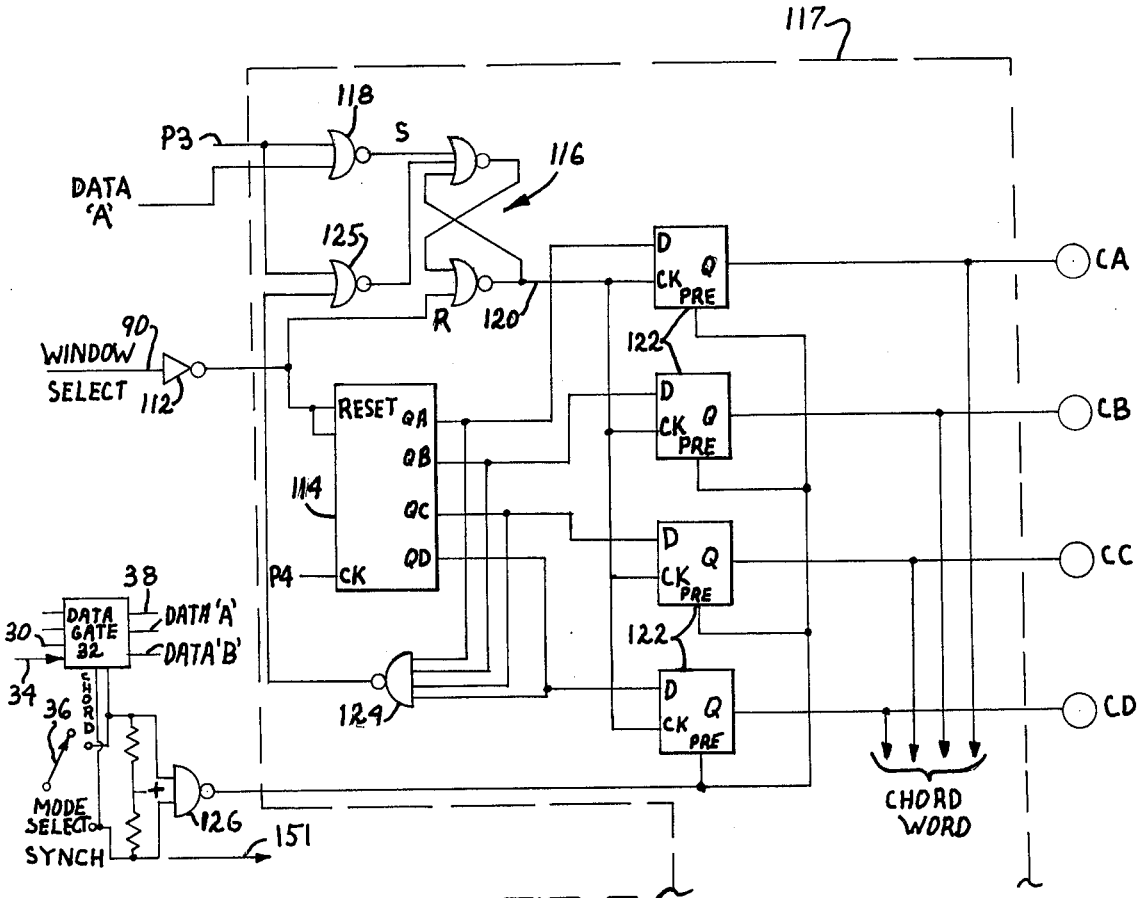
FIG. 7 is a part of the circuit showing the window select.

Referring to FIG. 7, the window select command, supplied to wire 90 by flip-flop 96, and which selects the keys of the accompaniment manual which will be the "chord playing" keys, is inverted by inverter 112. The output of inverter 112 is connected to the reset-enable input of a four bit binary down counter 114, and to the reset input to an S-R flip-flop 116. When the window select command is at logic 0, counter 114 is reset and is held at count 0, and flip-flop 116 is held in the reset condition. When the window select command changes to logic 1, as described previously, counter 114 is enabled to count, and flip-flop 116 is enabled to be set by any pulses occurring at the set input thereof. The clock input to counter 114 is connected to clock P4, and, therefore, counts one count for each key scanned by multiplexer 22.

The DATA 'A' output of data gate 32 is connected to the set input of flip-flop 116 through NOR gate 118. Key down signals occurring on data stream 30 will produce a pulse at the DATA 'A' output of data gate 32, and will set flip-flop 116. When flip-flop 116 is set, a rising edge will be produced on line 120. Line 120 is connected to the clocking input of a group of four D type flip-flops 122. A rising edge on line 120 will clock flip-flops 122, causing the logic level at the D inputs thereof to be transferred to the Q outputs thereon. The D inputs to flip-flops 122, are connected to the four outputs of counter 114. A key down signal occurring on data stream 30 during the time the window select command is enabled will, therefore, cause the four bit output of counter 114 to be clocked into a four bit latch composed of flip-flops 122. The four bit output of flip-flops 122 is, therefore, representative of the respective chord playing key of the accompaniment manual that is depressed. The four outputs of counter 114 are also connected to the inputs of a NAND gate 124. NAND gate 124 will provide a pulse during count 15 of counter 114, which is connected to the set input of flip-flop 116 through NOR gate 125. IF no key down signals have occurred at the DATA 'A' terminal, flip-flop 116 will be set by the pulse from NAND gate 124 and will cause flip-flops 122 to latch the binary word 1111, which is the binary representation of count 15. The binary word at the outputs of flip-flops 122 forms a CHORD WORD, and is used to develop data stream 34. The binary word 1111 corresponds to a condition in which none of the chord playing keys in the accompaniment manual is depressed and is effective to disable data stream 34. The outputs of flip-flops 122 are connected to the terminals numbered CA, CB, CC, and CD in FIG. 7 and also the wires marked "CHORD WORD" in FIG. 7.

Figure 8:
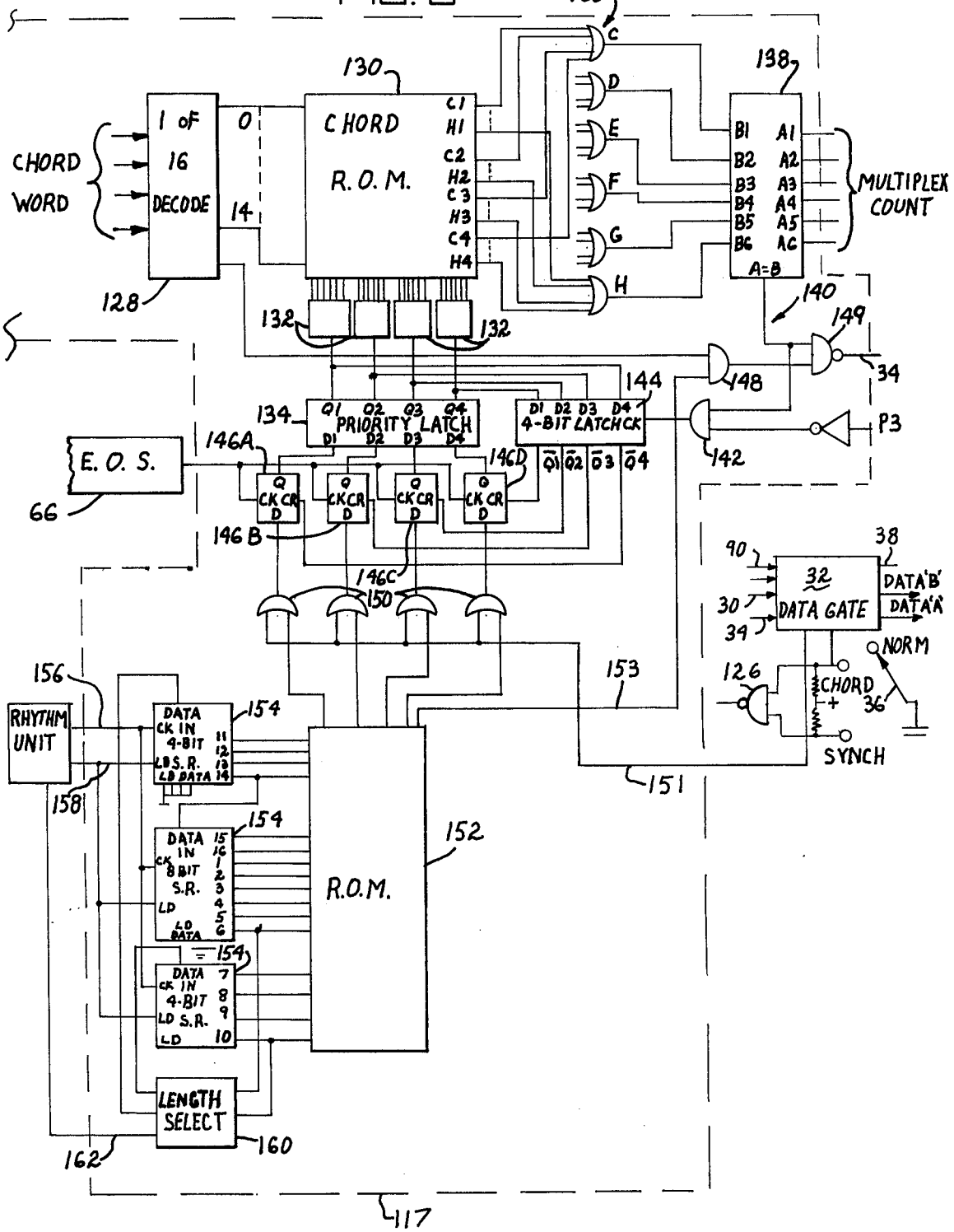
FIG. 8 is a part of the circuit showing the components employed for chord playing and swinging chord playing.

The method of converting the four bit chord word into a complete data stream containing key down signals in respective time slots corresponding to the selected chord is best explained by referring to FIG. 8.

In FIG. 8, the four bit chord word from FIG. 7 is connected to the input of a one of sixteen decoder 128. Decoder 128 enables one of the sixteen outputs thereof, by applying a logic 0 to that output, for each four bit input word. Outputs 0 through 14 of decoder 128 are connected to respective lines of a read only memory (ROM) 130. ROM 130 consists of four sections, with 15 lines in each section. Each section of ROM 130 has a corresponding six bit output, as indicated in FIG. 8 by C1-H1, C2-H2, C3-H3, and C4-H4. The outputs are combined in OR gates 136 to form a single six bit output, which is connected to one word input of a magnitude, or word, comparator 138, to be described hereinafter. The four sections of ROM 130 are enabled one at a time by ROM feed circuits 132 and a priority latch 134.

Priority latch 134 has four inputs, labeled D1 through D4. Latch 134 is a priority latch, and will enable only the Q output corresponding to the lowest numbered D input at which an enabling signal, namely, a logic 1 signal, is present.

With selector switch 36 in the position labeled CHORD, as previously mentioned for Mode II, a logic 1 signal will be established at the first input of each of a group of four OR gates 150. The outputs of OR gates 150, which will therefor all be at logic 1, are connected to the D inputs of a group of D type flip flops 146A, 146B, 146C and 146D. The outputs of flip flops 146A through 146D are connected to the D inputs of priority latch 134, with the output from flip flop 146A connected to the D1 input, 146B to the D2 input, 146C to the D3 input, and 146D to the D4 input.

The clocking inputs to each of flip flops 146A through 146D is connected to the output of end of scan circuit 66. The output of circuit 66 will provide a clocking pulse to flip-flops 146A–D after each multiplexing cycle, causing the logic level 1 signal present at the D inputs to be transferred to the Q outputs. With all four of the Q outputs of flip flops 146A–D at logic level 1, as will be the case in Mode II operation, priority latch 134 will enable the Q1 output by establishing a logic 1 signal at that output. The Q1 output is connected through the respective read only memory feed circuits 132 to enable the first section of ROM 130. The Q outputs of priority latch 134 are also connected to the D1 through D4 inputs of a four bit latch 144, with output Q1 connected to the D4 input, output Q3 connected to the D2 input, output Q2 connected to the D3 input, and output Q4 connected to the D1 input. The corresponding outputs of latch 144, Q1 through Q4, are connected to the clear inputs of flip flops 146A through 146D, with output Q1 connected to the clear terminal of flip flop 146D, and so on, as shown in FIG. 8.

With the first section of ROM 130 enabled, and one of the 15 lines is addressed by decoder 128, as described above, a respective six bit binary word will be established at the C1 through H1 outputs of ROM 130, and through OR gates 136, as one word input to the B inputs of word comparator 138. A second word input to the A inputs of comparator 138 is taken from bits C through H of counter 14. Comparator 138 will produce a pulse on line 140 whenever the binary word input from ROM 130 and the binary word input from counter 14 are equal. Since counter 14 counts during the multiplexing cycle, the binary word contained in each location of ROM 130 represents a specific key on the accompaniment manual, and the output pulses on line 140 are used to form the previously mentioned second data stream 34, with each pulse from the comparator forming one negative going key down signal.

Line 140 is also strobed with the P3 clock in AND gate 142 and connected to the clocking input of latch 144. Whenever a pulse is produced on line 140, latch 144 is clocked, transferring the D inputs of latch 144 to the Q outputs thereof while complementing them. One of the Q outputs of priority latch 134 will be enabled to go to logic 1, while all other outputs of priority latch 134 will be at logic 0. After the clocking pulse on line 140, the signals present at the outputs of priority latch 134 will be transferred to the $\overline{Q}$ outputs of latch 144. The logic 0 signal present at the one $\overline{Q}$ output of latch 144 will cause the corresponding flip flop 146 to be cleared. Specifically, if the Q1 output of priority latch 134 is enabled, after the pulse on line 140, flip flop 146A will be cleared. Similarly, if output Q2 of priority latch 134 is enabled, flip flop 146B will be cleared.

Starting with the pulse from end of scan circuit 66, the outputs of all four flip flops 146 will be at logic 1, and the Q1 output of priority latch 134 will be enabled. When word comparator 138 produces a pulse on line 140, flip flop 146A will be cleared, thus releasing the Q1 output of priority latch 134, and establishing an enabling signal at the Q2 output thereof. As counter 14 continues to count, a total of four pulses may be produced on line 140, depending on the magnitude of the words programmed into ROM 130. The words programmed into ROM 130 are such that the pulses produced on line 140 are produced in specific timed relations, corresponding to keys of a chord.

Line 140 is connected through NAND gate 149 to form data stream 34. A second input to NAND gate 149 provides a disabling input, which is activated through AND gate 148 whenever there are none of the chord playing keys on the accompaniment manual pressed.

FIG. 11 shows a measure of music with two chords of three notes each therein which are caused to sound by the successive depression of a pair of the chord playing keys. Each chord could consist of as many notes as desired and as many chords will sound during a measure as there are chord playing keys depressed in succession.

MODE III

With selector switch 36 in the third position, labeled SYNC, the operation of data gate 32, decoder 128, ROM 130, word comparator 138, priority latch 134, four bit latch 144, and flip flops 146A through 146D are the same as described above for MODE II. However, the previously mentioned first input supplied via wire 151 to each of OR gates 150 (FIG. 8) will now be a logic 0 signal and the level of the outputs of gates 150 will be under the control of read only memory 152 as described below.

The second inputs to OR gates 150 are connected to respective ones of the four bit output of a read only memory (ROM) 152. The output of ROM 152 will then have control over the logic levels clocked into the outputs of flip flops 146A through 146D after each multiplexing cycle. The output of ROM 152 will contain from one to four logic 1 signals and, therefore, from one to four sections of ROM 130 will be enabled sequentially during each multiplexing cycle, thus producing a corresponding number of pulses on line 140 and producing a corresponding number of key down signals in the data stream on wire 34 during the respective multiplexing cycle.

ROM 152 consists of 16 lines of five bits each. Each line of ROM 152 is enabled sequentially by a shift register 154. Shift register 154 is clocked by a relatively low frequency train of clock pulses on wire 156. The frequency of the trains of clock pulses is substantially lower than the frequency of the trains of clock pulses on wire 12. The low frequency clock pulses may be taken, for example, from an organ rhythm unit.

A second signal taken from the organ rhythm unit, and consisting of a single pulse for every sixteen clock pulses on wire 156, and hereinafter referred to as sync pulse 158, is used to initialize shift register 154 for each rhythm cycle. Sync pulse 158 establishes disabling signals on all outputs of shift register 154, except output 1, and establishes an enabling signal thereon, thus enabling line one of ROM 152. As the clock train on wire 156 pulses, the enabling signal is shifted along shift register 154, thus, enabling the lines of ROM 152 in succession.

The sections of ROM 130 will be enabled and operate the same as in the case of MODE II operation. However, the order in which the sections of ROM 130 are enabled will now depend solely on the information programmed into ROM 152. A second single line output 153 of ROM 152 is also provided. Output 153 will be normally at logic level 1, but can be programmed to logic level 0 to provide a disabling signal through AND gate 148 to NAND gate 149, thus preventing the addition of pulses to data stream 34. Output 153 of ROM 152 can thus be used to program a pause into the rhythm pattern.

A one line to two line demultiplexer 160 is used to shorten the length of shift register 154 whenever the 3/4 rhythm pulses are selected in the rhythm unit. The 3/4, 4/4 select command 162 forms the addressing input to demultiplexer 160. The output pulses from demultiplexer 160 will load the enabling signal from bit six of shift register 154 into either bit seven, when the 4/4 clock train is selected, or directly into bit eleven of shift register 154 when the 3/4 clock train is selected. Sync pulse 158 will also pulse once for every 12 pulses of clock train 156 whenever the 3/4 clock train is selected.

When operated in MODE III, as described above, the organ will sound the notes of a selected chord singly, or in any combination, and in time with pulses from the rhythm unit. Further, the notes, or combination of notes, may be sounded in any desired order by proper programming of ROM 152.

FIG. 12 shows the measures played in Mode III and it will be seen that the notes pertaining to the chord playing keys are sounded in several combinations depending on programming of ROM 152 and at the intervals determined by the low frequency clock pulses of train 156.

Also provided in the circuit of the present invention are outputs indicating the status of the number of keys depressed on the accompaniment manual. Referring to FIG. 1, a steady state key down detect circuit 200, and a percussion key down detect circuit 202 are shown in block form. Circuit 200 monitors the data stream on line DATA 'A', and produces a logic 1 signal during any multiplexing cycle following any cycle during which any key down signals occurred. Circuit 202 produces a logic level 1 pulse for a short time after any multiplexing cycle during which the number of keys depressed in the accompaniment manual is increased over the previous cycle, or in Mode III by the DATA 'B' stream. The details of circuits 200 and 202 are shown more completely in FIG. 9.

Figure 9:
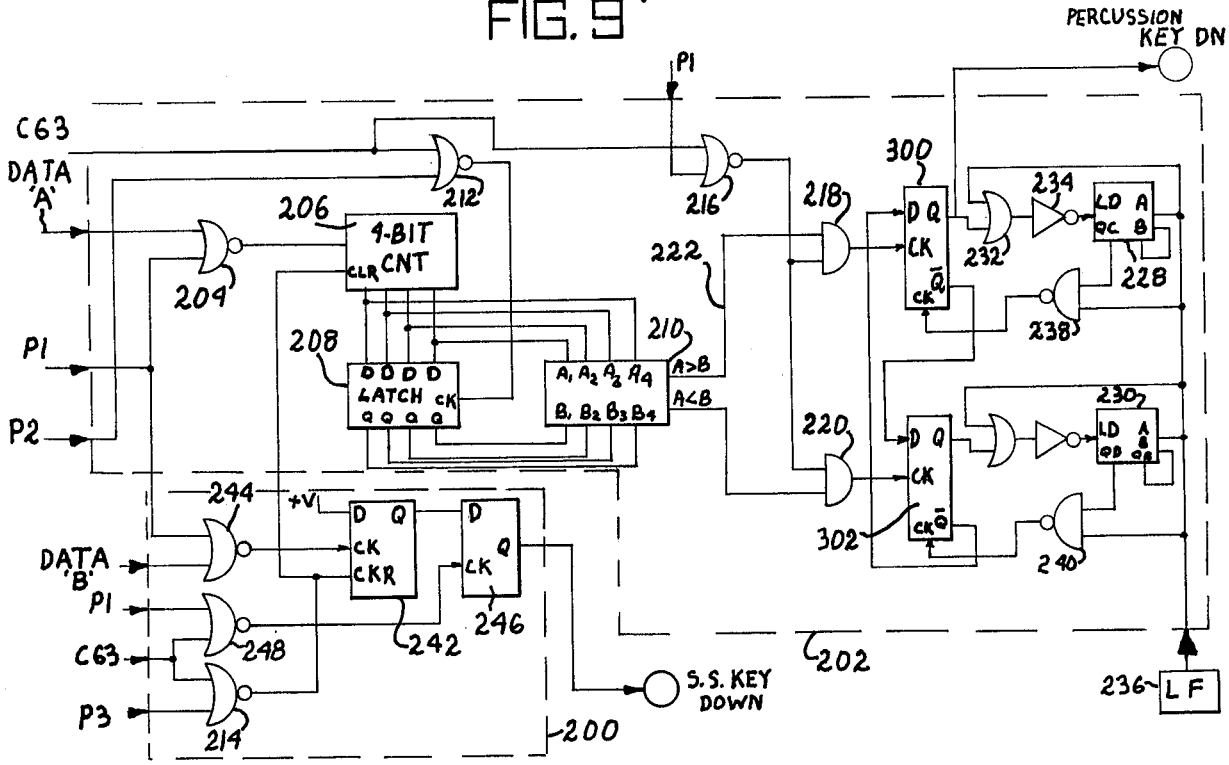
FIG. 9 shows an alternate circuit arrangement forming a modification of the circuit of FIG. 8.

Referring to FIG. 9, the DATA 'A' output of data gate 32 is connected through NOR gate 204 to the clocking input of a counter 206. The four bit output of counter 206 is connected to the D inputs of a four bit latch 208 and to one word input of a word comparator 210. The count 63 pulse from count decoder 60 is strobed with P2 clock in NOR gate 212 and is connected to the clocking input of latch 208. The count 63 pulse is also strobed with the P3 clock in NOR gate 214 and forms the clear input to counter 206. The output of latch 208 forms the second word input to word comparator 210. The count 63 pulse occurs after the entire key board is scanned, and the output of counter 206 therefor represents the number of keys depressed on the accompaniment manual.

Count 63 is strobed with the P1 clock in NOR gate 216, and forms the enabling input to AND gates 218 and 220. Prior to the pulse from NOR gate 212 the output of latch 208 will contain the output of counter 206 after the previous multiplexing cycle, and therefore the number of keys pressed during the previous cycle, while the output of counter 206 represents the number of keys pressed during the just completed multiplexing cycle.

If the output of counter 206 is greater than the output of latch 208, the output of comparator 210 connected to wire 222 will be pulsed to logic 1. The signal on wire 222 will then remain at logic 1 until the output of NOR gate 212 provides a clocking pulse to latch 208.

The output of NOR gate 216 will pulse to logic 1 prior to the output of NOR gate 212 and, therefore, the logic 1 signal on wire 222 will cause the output of AND gate 218 to pulse to logic 1.

The output of AND gate 218 is connected to the clocking input of D type flip flop 300, causing the logic level of the D input to be transferred to the Q output thereof.

If the logic level of the D input to flip flop 300 is a logic 1 at the time AND gate 218 pulses the clocking input, the output of OR gate 232 will be held at logic 1 by the Q output of flip flop 300. The output of OR gate 232 is connected, through inverter 234, to the load input of a counter 228. When the output of OR gate 232 is held at a logic 1, the load input to counter 228 is inactive and counter 228 will count in response to pulses received from a source of low frequency clock pulses 236.

When the Q output of flip flop 300 is a logic 0, the output of OR gate 232 will follow the clock pulses from source 236, and the load input to counter 228 will be repeatedly pulsed to logic 1, thus preventing counter 228 from counting.

The third Q output, Q*c*, of counter 228 is NANDED with the low frequency pulses from source 236 in NAND gate 238. The output of NAND gate 238, which will pulse to logic 0 approximately eight counts of the low frequency pulses from source 236 after the Q output of flip flop 300 goes to logic 1, is connected to the clearing input to flip flop 300, and will cause the Q output of flip flop 300 to switch to logic 0.

The Q output of flip flop 300 is connected as the output of the percussion key down detect circuit and will develop a logic level 1 pulse for a short period of time, as determined by the frequency of the pulses from source 236, immediately after the number of keys depressed on keyboard 24 is increased.

The output of AND gate 220 is connected to the clocking input of a D type flip flop 302, which controls a counter 230 in the same manner as described above for flip flop 300 and counter 228. However, the fourth Q output, or QD, from counter 230 is used to clear flip flop 302. Thus the logic 1 signal at the Q output of flip flop 302 will remain for approximately sixteen counts of the pulses from source 236.

The $\overline{Q}$ output of flip flop 302 is connected to the D input of flip flop 300, and the $\overline{Q}$ output of flip flop 300 is connected to the D input of flip flop 302.

The Q output of flip flop 300 cannot be set to logic 1 whenever the Q output of flip flop 302 is at logic 1. Similarly, the Q output of flip flop 302 cannot be set to logic 1 whenever the Q output of flip flop 300 is at logic 1.

This interconnection between flip flops 300 and 302 prevents erroneous settings of either flip flop due to key bounce.

Again referring to FIG. 9, the steady state key down detect circuit is shown inside the line marked 200. Any key down signals at the DATA 'B' output of data gate 32 will provide a clocking input to flip flop 242 through NOR gate 244. The D input to flip flop 242 is connected to logic 1 permanently, so that any, or any number of, key down signals at the DATA 'A' input to circuit 200 will produce a logic 1 signal at the Q output of flip flop 242. The Q output of flip flop 242 is connected to the D input of flip flop 246. Flip flop 246 is clocked by the output of NOR gate 248 during count 63 strobed with the P1 clock pulse in NOR gate 248.

The output of NOR gate 214 will clock flip flop 242 after the clocking pulse from NOR gate 248 is provided to flip flop 246. The output of flip flop 246 forms the output of circuit 200 and will remain at logic level 1 for a full multiplexing cycle following any cycle during which any key down signals are produced in the accompaniment manual data stream.

For a processing arrangement having fewer options and adapted for use with an organ not having a rhythm attachment, the modified circuit of FIG. 10 may be employed.

In FIG. 10, decoder 128, ROM 130, ROM feed circuits 132, OR gates 136, word comparator 138, and NAND gate 149 are illustrated and will operate in the same manner as the operation described in respect of MODES II and III. However, the sections of ROM 130 will now be enabled by outputs from a shift register 310 which is initialized by the end of scan pulses from circuit 66. When the shift register 310 is thus initialized, an enabling signal is established at the QA output thereof and a disabling signal is established at all other outputs.

Line 140, connected to the output of word comparator 138, is also connected to the D input of a D type flip flop 312. Flip flop 312 is clocked by the inverted P4 clock pulse and any logic 1 signal on line 140 which corresponds to a key down signal to be inserted in data stream 34 will be transferred from the D input of flip flop 312 to the Q output thereof.

The Q output of flip flop 312 is connected to the shift "right" input of register 310 so that when the register is clocked by the P4 clock pulse, the enabling signal therefrom will shift from the QA output to the QB output. The second section of ROM 130 will thus be enabled thereby presenting a new word to the first input of comparator 138 and releasing the key down signal therefrom. The inverted P4 clock pulse will then transfer a logic 0 to the Q output of flip flop 312 and release the shift command for register 310.

The second section of ROM 130 will remain enabled until another key down signal is produced by comparator 138 and will cause shift register 310 to enable the third section of ROM 130. The process is repeated for the fourth section of ROM 130.

When the end of scan circuit 66 produces a pulse after a multiplexing cycle, shift register 310 is reset by loading the logic levels of the inputs A, B, C, D respectively in a parallel fashion to the corresponding Q outputs. The parallel loading of the A through D inputs is produced by providing a logic 1 to both the S1 and the S0 inputs marked in FIG. 10.

The end of scan pulse for circuit 66, and which is positive going, is connected to input S1 and is inverted to form the preset input to flip flop 312. Whenever the preset input to flip flop 312 is pulsed low, the Q output is clocked to logic 1. The end of scan pulse from circuit 66 thus establishes an initial condition of logic 1 at the QA output of shift register 312 and logic 0 at all of the other outputs thereof.

Modifications may be made within the scope of the appended claims.

What is claimed is:

1. In an electronic organ having tone generator means, transducer means, keyers controlling the supply of tone signals from the generator means to the transducer means, keyboard means comprising playing keys, multiplexer means having an output and including a clock driven counter producing a pluaality of data words at the output thereof and operable for cyclically scanning said keyboard and developing a data stream at the output of the multiplexer means on each scan comprising time displaced data bits in which key down signals corresponding to depressed ones of said playing keys appear in respective time slots, and demultiplexer means adapted to receive a data stream and operable for actuating said keyers in conformity with key down signals in the data stream, memory means in which a plurality of data words are stored which are equal to the data words developed by said counter on respective counts, said memory means having output means, playing key controlled means adapted to be made effective for causing said memory means to supply a single one of its data words at a time to the output means thereof, a comparator having one input supplied by the output of the counter and the other input supplied by the output means of said memory means, said comparator having an output at which a data stream is developed in which key down signals appear when the inputs to the comparator are equal, and selector means operable to connect either one only of said multiplexer means output and the output of said comparator to said demultiplexer means for supplying a data stream thereto and for causing said key controlled means to be effective when the output of said comparator is connected to said demultiplexer means.

2. An electronic organ according to claim 1 in which said key controlled means is operable to change the data word supplied by said memory means in response to the development of a key down signal at the output of said comparator.

3. An electronic organ according to claim 1 in which said memory means comprises a plurality of memory units each having a plurality of addressing inputs and an enabling input and each storing a plurality of data words equal to respective data words of said counter, said key controlled means including addressing means for addressing respective inputs of all of said memory units simultaneously, and enabling means operable for supplying enabling signals to a single one of said enabling inputs of said memory units at a time.

4. An electronic organ according to claim 3 in which said key controlled means comprises means operable in response to the actuation of the keys of a predetermined group of the keys of said keyboard.

5. An electronic organ according to claim 3 in which said enabling means is operable during a single scan of said keyboard means for supplying said enabling signals sequentially to said memory units.

6. An electronic organ according to claim 5 in which the counts from said counter vary continuously in one direction during a said keyboard scan and the signals produced by the memory units in conformity with the addressed inputs differ from each other, said enabling means enabling the memory units in such order that the successive data words therefrom differ from one another in the same direction as the successive counts of said counter.

7. An electronic organ according to claim 3 which includes means for controlling said enabling means to cause the enabling means to supply a said enabling signal to respective ones of said enabling inputs at intervals which are spaced chronologically the duration of a plurality of keyboard scans.

8. An electronic organ according to claim 7 in which said intervals occur rhythmically.

9. An electronic organ according to claim 7 which includes a source of rhythm pulses supplied according to a predetermined rhythm pattern, and means responsive to said pulses for causing said enabling means to supply an enabling signal to respective ones of said enabling inputs of said memory units at the same rate as said rhythm pulses are supplied.

10. The method of operating an electronic organ having tone generator means, transducer means, keyers controlling the supply of tone signals from the generator means to the transducer means, keyboard means comprising playing keys, multiplexer means having an output and including a clock driven counter and operable for cyclically scanning said keyboard and developing a data stream at said output on each scan comprising time displaced data bits in which key down signals corresponding to depressed ones of said playing keys appear in respective time slots, and demultiplexer means adapted to receive a data stream and operable for actuating said keyers in conformity with key down signals in the data stream which comprises: storing in a memory data words which are equal to respective counts of said counter, selecting a respective group of the stored data words for each playing key which is depressed, comparing the selected data words in succession with the counts of said counter and generating a pulse when a data word equals a count of the counter, utilizing said pulses to develop key down signals in respective time slots in a second data stream, and selectively supplying the data stream from said multiplexing means and said second data stream to said demultiplexer means.

11. The method according to claim 10 in which the respective data words of the selected group of signals are compared in succession with the output of said counter during an interval equal to that required for a single scan of the keyboard.

12. The method according to claim 10 in which the respective data words of the selected group of data words are compared in succession with the output of said counter at intervals each equal to that required for a plurality of scans of the keyboard.

13. The method according to claim 10 in which the respective data words of the selected group of data words are compared in succession with the output of said counter at rhythmically spaced intervals.

14. The method according to claim 11 in which each count of the counter varies from the preceding count in the same direction and each corresponds to a respective key of the keyboard during a scan of the keyboard, the successive data words compared to the counter counts varying in the same direction as the counter counts.

15. The method according to claim 12 in which the respective data words of the selected group of data words are compared with the counts of said counter in a predetermined order.

16. In an electronic organ having a keyboard tone generator means, transducer means, keyer means controlling the supply of tone signals from the generator means to the transducer means, and keyer actuating means adapted to receive a data stream and operable for actuating said keyer means in conformity with key down signals in the data stream:

memory means in which a plurality of signals are stored corresponding to notes called for by the playing of respective keys of the keyboard when they are depressed, said memory means having an output common to all of the stored signals, playing key controlled means for addressing those signals stored in said memory means which correspond to the notes called for by a depressed playing key and for causing said memory means to supply at the output thereof a single one of the addressed signals at a time, and data stream generating means for supplying a data stream to said keyer actuating means in which key down signals appear in time slots corresponding to the signals at the output of said memory means, said playing key controlled means including means for causing said memory means to supply a new signal at the output thereof from among the addressed signals each time a key down signal is placed on said data stream by said generating means.

17. In an electronic organ having a keyboard, tone generator means, transducer means, keyer means controlling the supply of tone signals from the generator means to the transducer means, multiplexer means for producing a data stream including key down signals, and keyer actuating means adapted to receive said data stream and operable for actuating said keyer means in conformity with the key down signals in the data stream:

memory means for storing a plurality of data words corresponding to notes playable by the organ, said memory means including an output on which the data words are selectably placed one data word at a time, means for placing a signal on a second data stream supplied to said keyer actuating means which corresponds to the data word at the output of said memory means, and processor means for addressing a group of selected ones of said data words and for placing one of said selected data words at said output a single one of said data words at a time, whereby a new selected data word is placed on said output each time the signal corresponding to the previous data word at said output is placed on said second data stream until signals corresponding to all of the data words in the group have been placed on said second data stream.

18. The electronic organ of claim 17 wherein:

said memory means comprises a plurality of memory units each storing a plurality of said data words corresponding to respective keys of the keyboard, said processor means addresses one of said data words in each of said memory units and enables a plurality of said memory units one at a time to place their respective said addressed word at said output.

19. The electronic organ of claim 18 wherein said processor means includes a priority latch having outputs connected respectively to said memory units.

20. The electronic organ of claim 18 wherein said first and second data streams are multiplexed data streams in which key down pulses appear in time slots corresponding to respective keys of the keyboard and said processor means places a new said selected signal on said output each time a key down pulse is placed on said second data stream.

* * * * *